United States Patent [19]

King

[11] Patent Number: 4,487,380

[45] Date of Patent: Dec. 11, 1984

[54] REELING DEVICE

[76] Inventor: William King, 79 Allison Rd., Elsternwick, Victoria, 3185, Australia

[21] Appl. No.: 422,908

[22] PCT Filed: Feb. 3, 1982

[86] PCT No.: PCT/AU82/00009

§ 371 Date: Sep. 13, 1982

§ 102(e) Date: Sep. 13, 1982

[87] PCT Pub. No.: WO82/02703

PCT Pub. Date: Aug. 19, 1982

[30] Foreign Application Priority Data

Feb. 3, 1981 [AU] Australia ..... PE7469

[51] Int. Cl.[3] ..... B65H 75/48

[52] U.S. Cl. ..... 242/107.3; 242/107.7

[58] Field of Search ..... 242/107.3, 107.7, 107.6, 242/107.12; 191/12.2 R, 12.4

[56] References Cited

U.S. PATENT DOCUMENTS

| | | | |
|---|---|---|---|
| 1,948,158 | 2/1934 | Barr | 242/107.7 |
| 2,555,560 | 6/1951 | Timm | 242/107.7 |
| 3,039,717 | 6/1962 | Appleton . | |
| 3,528,624 | 9/1970 | Tamarin . | |
| 3,596,849 | 8/1971 | Tamarin . | |
| 3,889,897 | 6/1975 | Van Zelderen . | |
| 4,206,888 | 6/1980 | Magvar | 242/107.7 |
| 4,227,661 | 10/1980 | King et al. | 242/107.7 |
| 4,293,107 | 10/1981 | Ziv | 242/107.7 |

FOREIGN PATENT DOCUMENTS

| | | |
|---|---|---|
| 165133 | 8/1954 | Australia . |
| 55-31713 | 3/1980 | Japan . |
| 1372897 | 11/1974 | United Kingdom . |

*Primary Examiner*—John M. Jillions

*Attorney, Agent, or Firm*—Andrus, Sceales, Starke & Sawall

[57] ABSTRACT

A reeling device including a reel (3) for holding, paying out and winding in a linearly extendable flexible member, means for biasing said reel in a direction of rotation (4) for winding in said member and a latching mechanism (21 and 23) adapted to prevent winding in of said member; the latching mechanism including a member (23) rotatable with the reel and movable under centrifugal force between a non-latching and latching position in consequence of the rate of rotation of the reel exceeding a predetermined magnitude.

6 Claims, 4 Drawing Figures

REELING DEVICE

This invention relates to a latching mechanism and to a reeling device.

The reeling devices in accordance with this invention can be used to reel anything desired but most application will be found in reeling hoses or electrical cable.

The present invention provides in one aspect a reeling device including a reel for holding, paying out and winding in a linearly extendable, flexible member, means for biasing said reel in a direction of rotation for winding in said member and a latching mechanism adapted to prevent winding in of said member; the latching mechanism including a member rotatable with the reel and movable under centrifugal force between a non-latching and latching position in consequence of the rate of rotation of the reel exceeding a predetermined magnitude.

The latching mechanism preferably includes said member which is attached to the reel and a stationary latch attached to a frame or casing.

Manually operable means may be provided to prevent latching at any rotational speed of the reel.

In another aspect the present invention provides a reeling device including a reel for holding, paying out and winding in a linearly extendable, flexible member, means for biasing said reel in a direction of rotation for winding in said member and means to limit the maximum rotational speed of the reel. That means preferably comprises brake means adapted to be brought into operation as a result of centrifugal force.

Specific constructions of reeling devices and associated latching mechanisms will now be described with the aid of the accompanying drawings in which.

Figure 2:
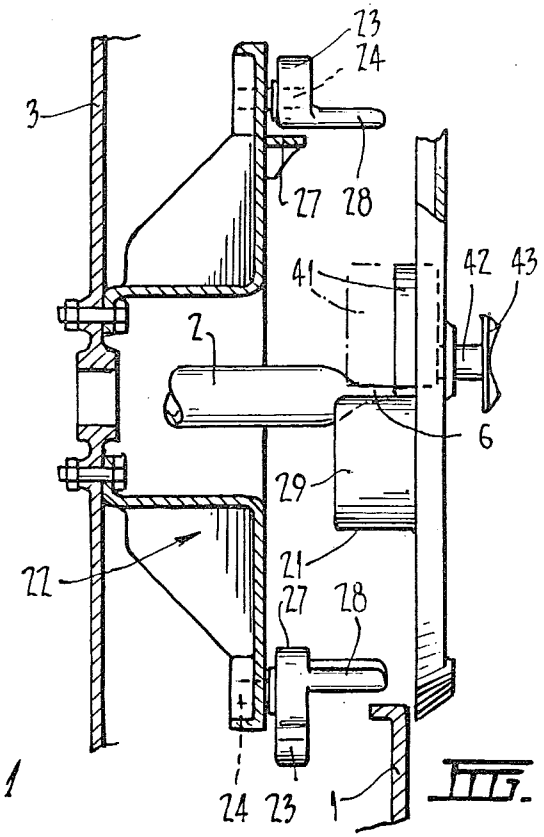
FIG. 2 is a cross-section on line A—A in FIG. 1.
Figure 1:
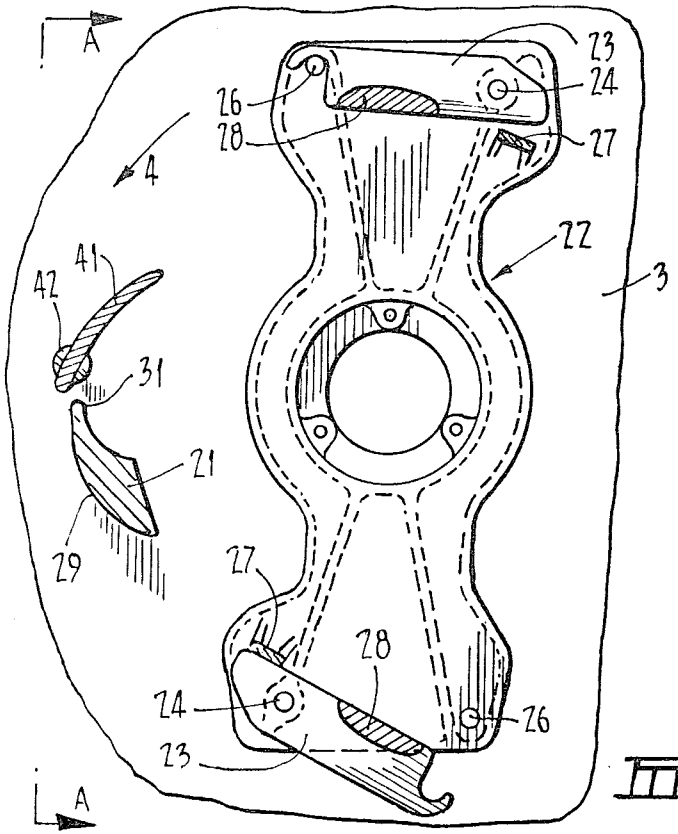
FIG. 1 is a side elevation of part of a first reeling device.

The reeling device shown in FIGS. 1 and 2 comprises an outer casing 1 which supports a shaft 2 on which a reel 3 for hose or the like is mounted for rotation. A spring (not shown) is attached to the shaft 2 and reel 3 for biasing the reel to rotate in a recoil direction indicated by arrow 4. An end 6 of the shaft 2 is flattened to enable it to be rotated to tension the spring.

A latching mechanism for the reel 3 comprises a projection 21 which extends from the casing 1 and a carrier 22 which is secured to the reel 3 and which carries two members 23 which are mounted to pivot on pins 24 between abutments 26 and 27. The members 23 carry projections 28.

When it is desired to pay out hose from the reel 3 the hose is grasped and pulled and will pay off the reel. In paying out the reel 3 turns in the opposite direction to arrow 4 and the projections 28 will be moved by the surface 29 of projections 21, which acts as a cam surface to ride over the projections 21. Gravity will also assist the projections 28 to pass over the projections 21 as is shown by the bottom one of the members 23 in FIG. 1.

To wind in hose the hose is released to allow the spring to turn the reel 3 in the direction of arrow 4 and winding in will occur. If the reel 3 rotates at a relatively fast rate the members 23 will be flung out under the influence of centrifugal force (see the lower member 23 in FIG. 1) and the projections 28 will pass over the projection 21 without engaging therewith. However, if reel 3 rotates at a relatively slow rate the members 23 will not be flung out to the same extent and instead will pass between the lip 31 on the projection 21 and the shaft 2 and as a result of abutting projection 21 the reel 3 will be prevented from winding in.

Thus, at relatively fast rates of rotation of reel 3 latching will not occur but at relatively slow rates of rotation of reel 3 latching will occur and those relatively slow rates may be had by a user holding the hose and controlling, by hand friction, its rate of winding in.

Since it may be desired that winding in without latching should occur at such relatively slow rates of rotation of reel 3 a manual means comprising a guide 41 mounted on an axially slidable pivot 42 provided with a push button 43 can be used. If the guide 41 is slid from the full line position in FIG. 2 to the dash line position in FIG. 2 by pushing on the button 43 the guide 42 will be in a position to guide the projections 28 over the projection 21 by moving the members 23 outwardly. The ability of pivot 42 to pivot is of use in paying out after latching with the button 43 depressed in that the projections 28 can cause the guide 41 to pivot so as not to restrict paying out.

Figure 4:
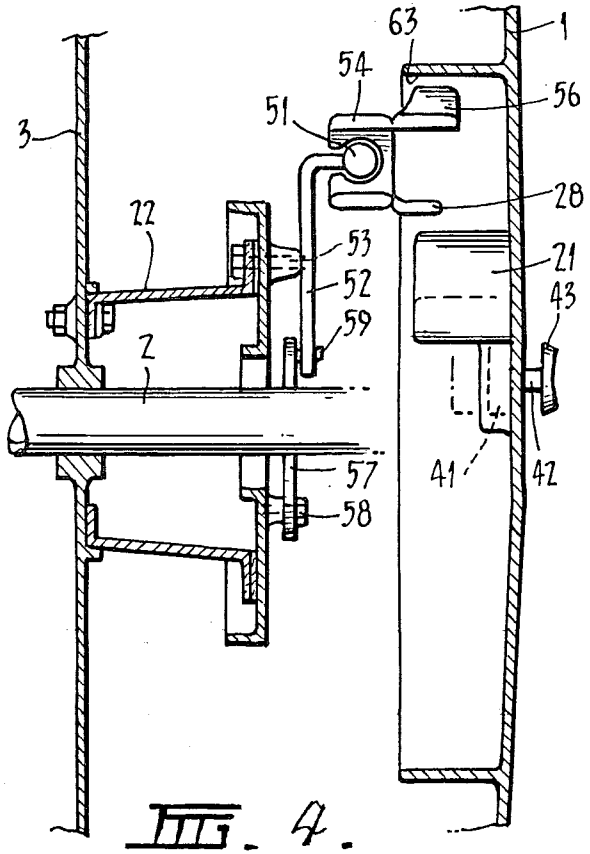
FIG. 4 is a cross-section through the second reeling device.
Figure 3:
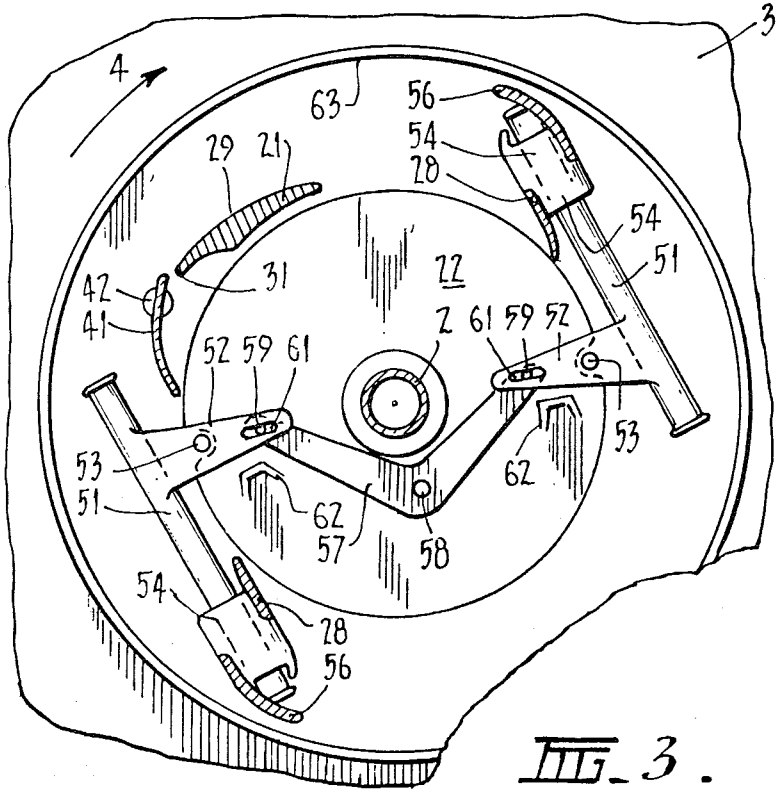
FIG. 3 is a side elevation of part of a second reeling device.

The reeling device of FIGS. 3 and 4 is similar to that of FIGS. 1 and 2 and like numerals denote like parts.

In this instance, however, the carrier 22 has two tubes 51 on arms 52 pivotally mounted thereto at 53, the tubes 51 carry sliders 54 having the projections 28 and brake surface 56, the arms 52 are connected to a linkage 57 which is pivotally mounted at 58 through pins 59 located in slots 61 and are limited in their movement by abutments 62, and the casing 1 has a brake surface 63.

To pay out hose from the reeling device of FIGS. 3 and 4 the hose is pulled to cause the reel 3 to rotate in the opposite direction to arrow 4, the carrier 22 rotates, the projections 28 move over the surface 29 of projection 21. Gravity effects on the lower one of the tubes 51 are at least partly eliminated by the linkage 57.

To wind in hose the hose is released to allow a spring (not shown) to turn the reel 3 in the direction of arrow 4 and winding in will occur. If the reel 3 rotates at a relatively fast rate the sliders 54 will be flung out under the influence of centrifugal force, the tubes 51 will pivot about 53 and the projections 28 will clear the projection 21. However, if reel 3 rotates in excess of a predetermined speed the surfaces 56 will act on surface 63 to cause braking.

If reel 3 rotates at a relatively slow rate the sliders 54 will not be flung out to the same extent and latching can occur in which the projections 28 engage with the projection 21.

The guide 41 permits similar manual release as in respect of FIGS. 1 and 2.

I claim:

1. A reeling device comprising a reel (3) rotatable about an axis for holding, paying out, and winding in a linearly extendable flexible member:

means for biasing said reel in a direction of rotation for winding in said flexible member: and a latching mechanism adapted to prevent winding in of said flexible member, said latching mechanism including:

a stationary member having an abutment (21), said stationary member having first and second guide surfaces respectively radially inward and radially outward with respect to the axis of rotation of said reel;

a latch member (23; 51, 54) having an abutment (28), said latch member being rotatable with said reel and pivotally attached to said reel so that the abutment (28) of said latch member is movable under centrifugal force during winding in of said flexible member between a latching first position and a non-latching second position that are, respectively, relatively radially inward and relatively radially outward of the axis of rotation of said reel; said abutment (28), when in said first position, describing a circle of relatively small radius as the reel rotates for winding in of said flexible member that intersects with said abutment (21) of the stationary member for preventing winding in of the flexible member; and said abutment, when in the second position, describing a circle of relatively large radius as the reel rotates for winding in of the flexible member that is located radially outward of, and does not intersect with, said abutment (21) of the stationary member for permitting winding in of the flexible member, said first guide surface of said stationary member being adapted to guide said abutment (28) on said latch member into latching abutment with said abutment (21) on said stationary member when said abutment (28) on said latch member is describing a circle of rotation during winding in of said reel having a radius of a predetermined magnitude less than said relatively large radius, and wherein said second guide surface of said stationary member is adapted to guide said abutment (28) on said latch member toward said second position and away from abutment with said abutment (21) on the stationary member when said abutment (28) on said latch member is describing a circle of rotation during winding in of the reel having a radius greater than said radius of said predetermined magnitude in consequence of the rate of rotation of the reel exceeding a predetermined magnitude; and a guide member (41, 42) movable between a latch non-interference position in which said guide member makes no latch preventing contact with said latch member and a latch interference position in which said guide member directs said abutment (28) on said latch member radially outward of the first guide surface, irrespective of the radius of the circle of rotation being described by said abutment (28) on said latch member prior to the latch member contacting said guide member, thereby to prevent latching at any rotational speed of said reel.

2. A reeling device as claimed in claim 1 wherein said first and second guide surfaces of said stationary member are convergent in a direction generally contra to the direction of rotation of said reel during winding in.

3. A reeling device as claimed in claim 1 wherein said guide member (41, 42) is movable between the latch interference position and the latch non-interference position in a direction generally parallel to the axis of rotation of the reel.

4. A reeling device as claimed in claim 1 including means (56) to limit the maximum rotational speed of said reel.

5. A reeling device as claimed in claim 1 wherein said latch member carries a body (54) slidable therealong in response to centrifugal force and wherein said body carries said abutment (28) on said latch member.

6. A reeling device as claimed in claim 5 wherein said body (54) has a first friction surface (56) and wherein stationary second friction surfaces (63) are provided in said reeling device so that said body (54) will move under winding in of said reel (3) in excess of a predetermined rate to bring said first and second friction surfaces into contact to slow rotation of said reel.

* * * * *